United States Patent [19]

Scelba et al.

[11] Patent Number: 4,856,306

[45] Date of Patent: Aug. 15, 1989

[54] ZIPPER LOCKING APPARATUS FOR LUGGAGE CASES

[75] Inventors: Stephen S. Scelba, Clifton, N.J.; Martin R. Feinberg, Denver, Colo.

[73] Assignees: Presto Lock, Inc., Garfield, N.J.; Samsonite Corporation, Denver, Colo.

[21] Appl. No.: 19,514

[22] Filed: Feb. 27, 1987

[51] Int. Cl.[4] ..... F05B 67/38

[52] U.S. Cl. ..... 70/68; 70/312; 190/903

[58] Field of Search ..... 70/312, 315–318, 70/3–5, DIG. 79, 68, 76, 74; 190/119, 120, 903

[56] References Cited

U.S. PATENT DOCUMENTS 3,210,971 10/1965 Vandamme ..... 70/68
4,019,353 4/1977 Christopher ..... 70/68

FOREIGN PATENT DOCUMENTS 164614 4/1949 Fed. Rep. of Germany ..... 70/68

*Primary Examiner*—Lloyd A. Gall
*Attorney, Agent, or Firm*—Shapiro and Shapiro

[57] ABSTRACT

A double zipper lock for a luggage case comprises a base with a housing containing a combination lock, and a U-shaped loop adapted to embrace the housing. Arms of the loop are pivotally mounted on opposite ends of the housing and a bight portion of the loop cooperates with portions of the base to form chambers that, when closed, trap zipper sliders. When the combination lock is set on-combination, the user may lift the loop, to free the sliders, by engaging the bight portion with the fingers of a hand and using the thumb to press a manual actuator inwardly of the housing. The actuator is part of a bolt that is supported for pivotal and translational movement. The translational movement, which is permitted only when the lock is on-combination, causes pivotal movement of a latch member from a latching position to an unlatching position. In the latching position, the latch member prevents lifting of the loop.

7 Claims, 4 Drawing Sheets

ZIPPER LOCKING APPARATUS FOR LUGGAGE CASES

BACKGROUND OF THE INVENTION

This invention relates to zipper locks and the like and is more particularly concerned with a double zipper lock for luggage cases.

Soft-sided luggage cases commonly have a double zipper, the sliders of which are locked together to prevent access to the interior of the case. In its simplest form, a double zipper lock may be constituted by a padlock, the shackle of which is passed through openings in the zipper slider pull tabs. More sophisticated double zipper locks are disclosed, for example, in U.S. Pat. Nos. 4,366,684; 3,978,697; 3,597,945; 4,031,723 and 3,319,743. All of these double zipper locks require a post which is inserted through an opening of each zipper pull tab. Some structure, such as a locked cover plate, is provided to prevent removal of the pull tabs from the post, so that the sliders are retained.

BRIEF DESCRIPTION OF THE INVENTION

The double zipper lock of the present invention is simpler than prior art apparatus with respect to its construction and mode of operation. More particularly, the apparatus of the present invention merely traps the zipper sliders by forming around each slider a chamber having a wall that prevents removal of the slider when the chamber is closed.

In one of its broader aspects, zipper locking apparatus in accordance with the invention comprises means adapted to be attached to a luggage case for forming a chamber capable of being opened and closed, said chamber being configured to receive a zipper slider therein and having chamber-defining wall means for enclosing and trapping the zipper slider within the chamber when the chamber is closed and for freeing the zipper slider when the chamber is opened.

Although the invention can be implemented in different forms of apparatus, a preferred embodiment will be disclosed herein that employs a zipper locking apparatus disclosed and claimed in a companion application Apparatus for Luggage Cases, Ser. No. 019,946 filed concurrently.

BRIEF DESCRIPTION OF THE DRAWINGS

The invention will be further described in conjunction with the accompanying drawings, wherein.

DETAILED DESCRIPTION OF THE PREFERRED EMBODIMENT

Figure 1:
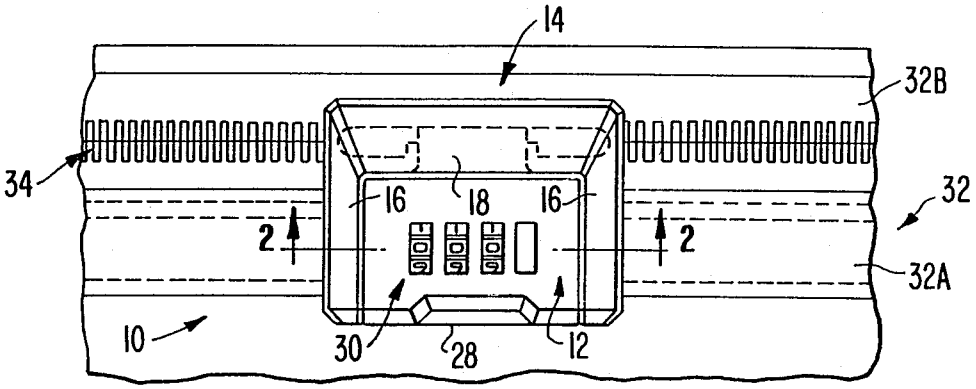
FIG. 1 is a fragmentary plan view showing a portion of a luggage case with apparatus embodying the invention installed thereon and retaining the sliders of a double zipper.
Figure 3:
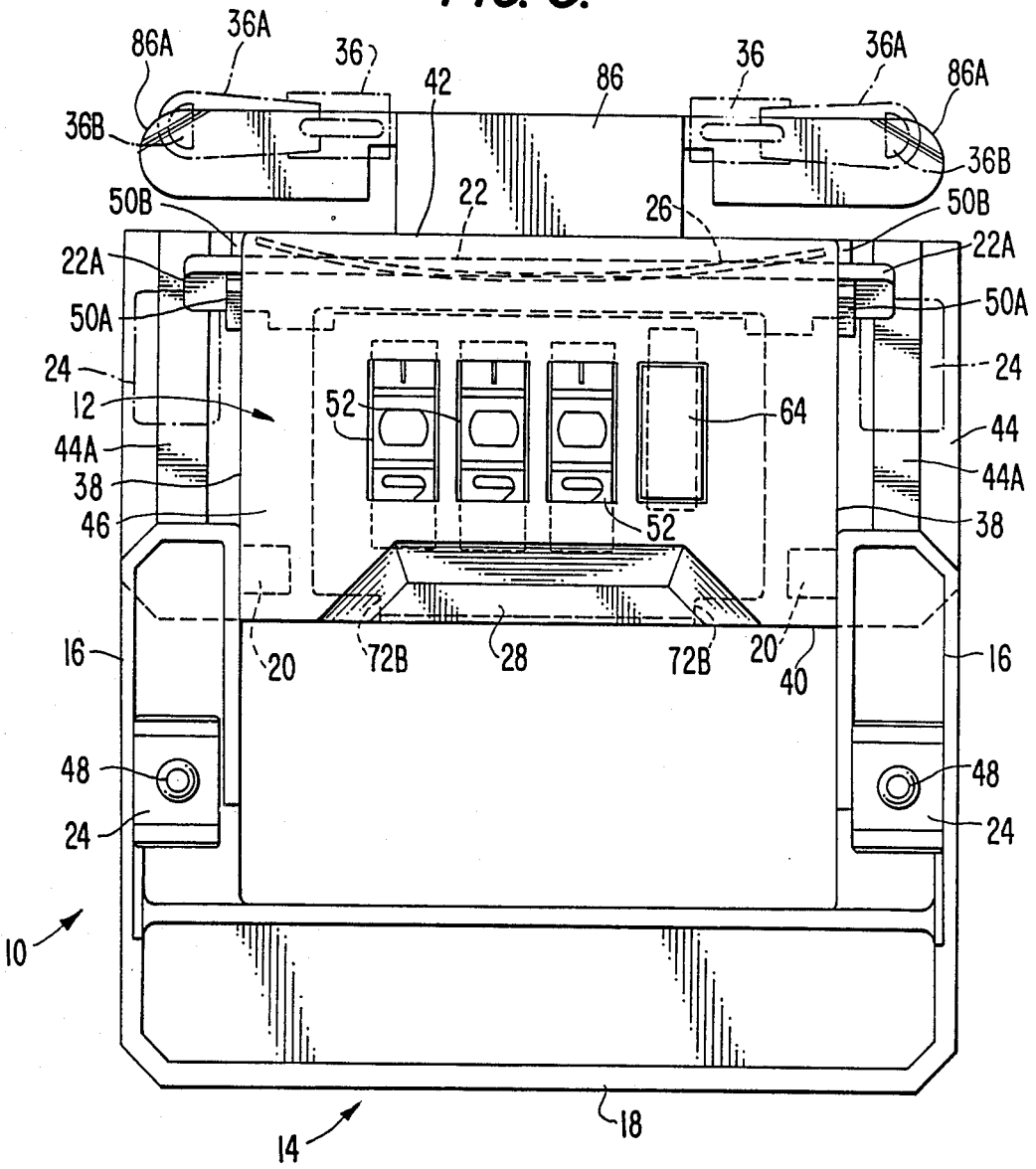
FIG. 3 is a plan view of the apparatus, in which a loop that forms part of the apparatus has been moved from a closed position (FIG. 1) to an open position to release the zipper sliders.

Referring to the drawings, apparatus 10 employed in the invention may comprise a base 12 and a loop 14 mounted on the base for pivotal movement between a closed position shown in FIG. 1 and an open position shown in FIG. 3. In its closed position, the loop embraces the base as shown in FIG. 1. The loop includes a pair of arms 16 and a bight portion 18 connecting the arms. The arms 16 are pivotally mounted on the base by pivot pins 20.

The loop 14 is releasably held in its closed position by a latch mechanism comprising a latch member 22 and a pair of retainers 24 engageable with the latch member. The latch member is preferably a plate pivotally mounted on the base 12 and having end portions 22A cooperable with the retainers 24. See FIG. 7. Latch member 22 is resiliently biased into engagement with retainers 24 by a leaf spring 26 and is disengaged from the retainers 24 by a manual actuator 28. The retainers 24 are mounted on corresponding arms 16 of the loop 14, and the loop (which may be considered a latch part) is held in its closed position when the latch member 22 engages the retainers. A lock mechanism 30 controls the ability of the manual actuator 28 to disengage the latch member 22 from the retainers 24. The base 12, loop 14, and manual actuator 28 are dimensioned to provide a structure which permits a user of the apparatus to lift the loop by engaging fingers of a hand with the bight portion 18 while simultaneously engaging the thumb of the hand with the manual actuator 28 and pressing the manual actuator toward the bight portion 18. Further details of the foregoing component parts of the apparatus and their operation will be set forth later.

The apparatus described above may be employed to provide a double zipper lock for a luggage case 32 as shown in FIG. 1. For this purpose, the base 12 is preferably mounted centrally on the front wall of the body 32A of the luggage case adjacent to the lid 32B of the case by means of integral rivets 12A shown in FIGS. 4–6. In a well-known manner, the lid is adapted to be secured to the body of the case by a double zipper 34 extending from the rear wall of the case and around the end walls of the case to the center of the front wall of the case, with the tapes of the zipper being attached to the lid and body of the case in the usual manner. The rear wall of the lid is, of course, attached to the rear wall of the body of the case by hinges in the usual manner.

The double zipper 34 preferably comprises a pair of separate zippers that terminate at the apparatus 10, but in some instances a single zipper may be employed. In either event, the double zipper will have a pair of zipper sliders 36 each having the usual pull tab 36A pivotally connected to the body of the slider that operates the zipper teeth. As will be described more fully hereinafter, when the zipper sliders are brought to predetermined locations centrally of the front wall of the case 32, they may be held in that position when the loop 14 is in its closed position (FIG. 1). As is apparent from FIGS. 1 and 3, the zipper locking apparatus 10 of the invention is supported on the case 32 with the pivotal axis of the loop 14 (defined by pivot pins 20) at one side of and substantially parallel to the zipper 34.

Turning now to further details of the apparatus, the base 12 constitutes a housing of rectangular configuration having opposite end walls and opposite side walls.

Figure 2:
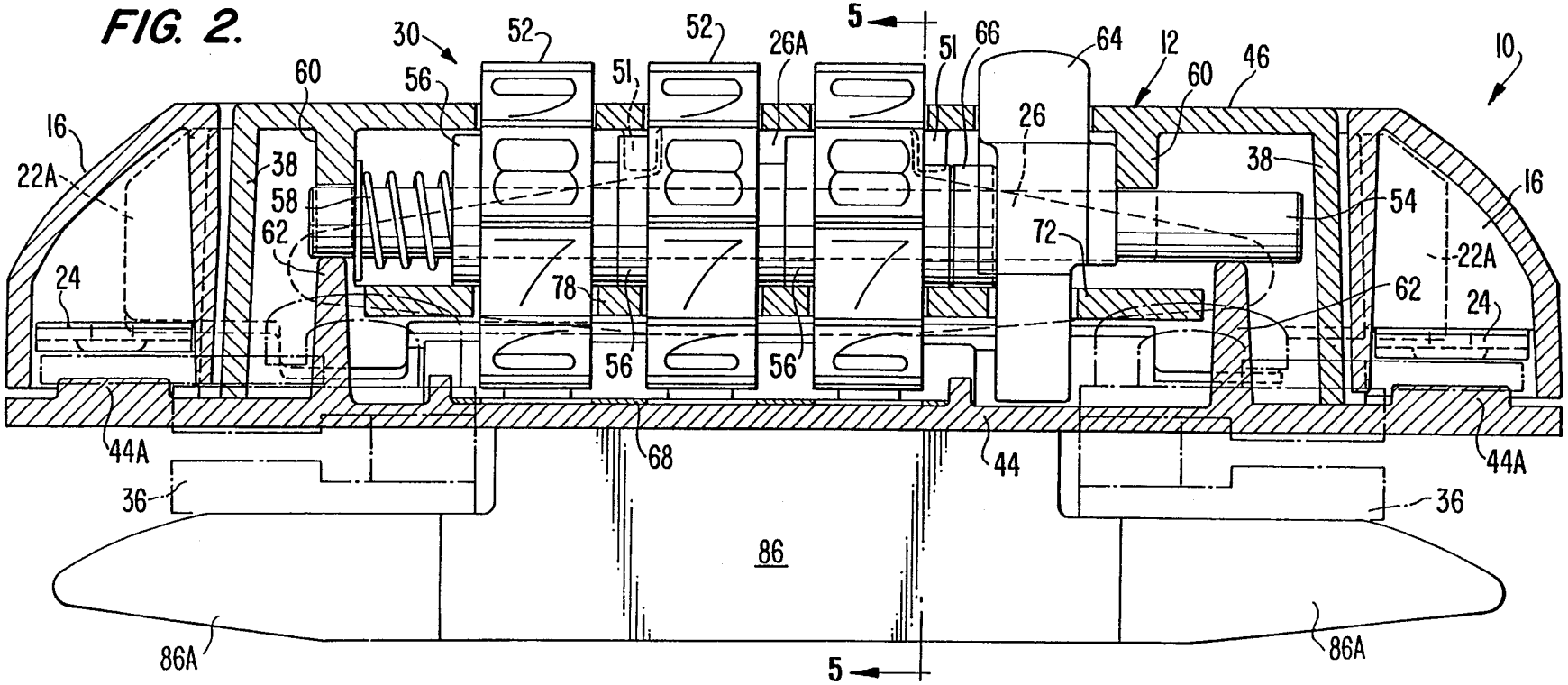
FIG. 2 is an enlarged longitudinal sectional view along line 2—2 of FIG. 1.
Figure 5:
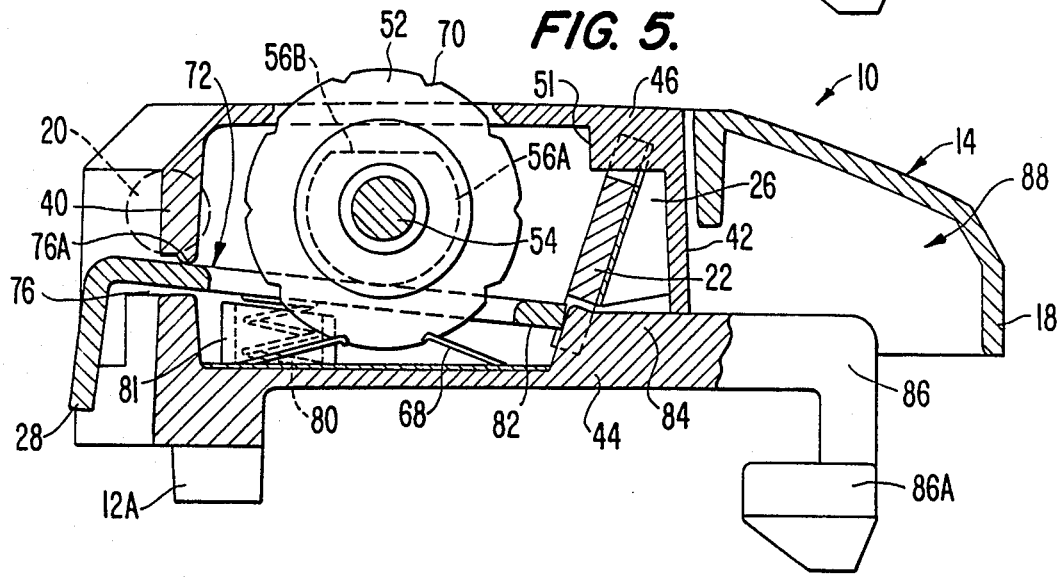
FIGS. 5 and 6 are transverse sectional views along line 5—5 of FIG. 2 and illustrating different operational conditions of the apparatus.
Figure 6:
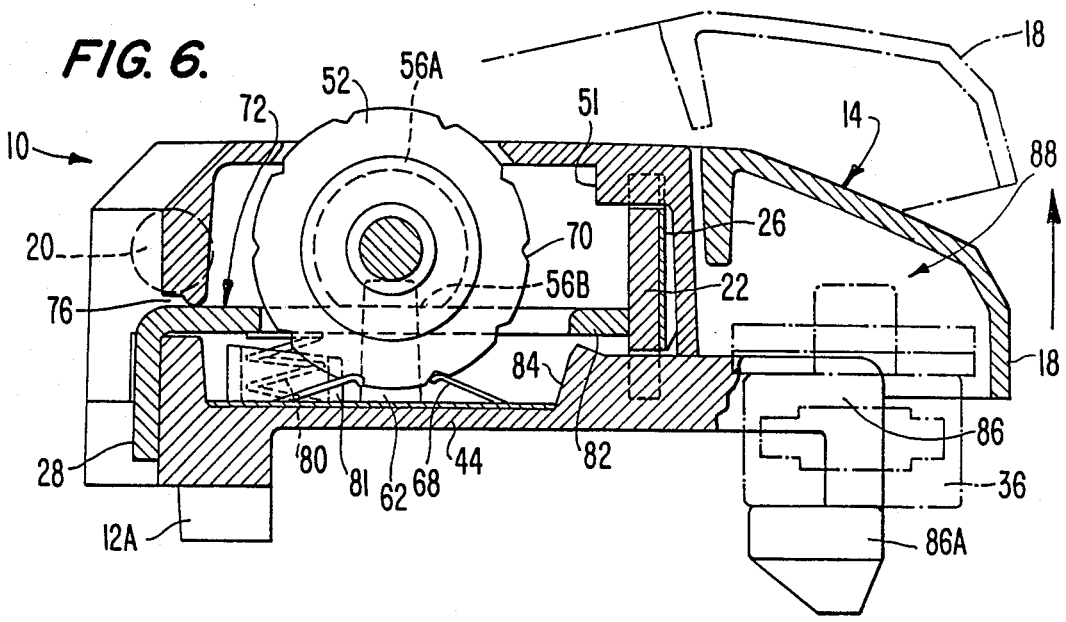

The opposite end walls are shown at 38 in FIG. 2, and the opposite side walls are shown at 40 and 42 in FIGS. 5 and 6. The housing includes a frame 44 providing the bottom portion of the housing and a hollow cover 46 providing the top portion of the housing (including the end walls and side walls). The cover 46 and frame 44 are joined by rivets (not shown).

Figure 4:
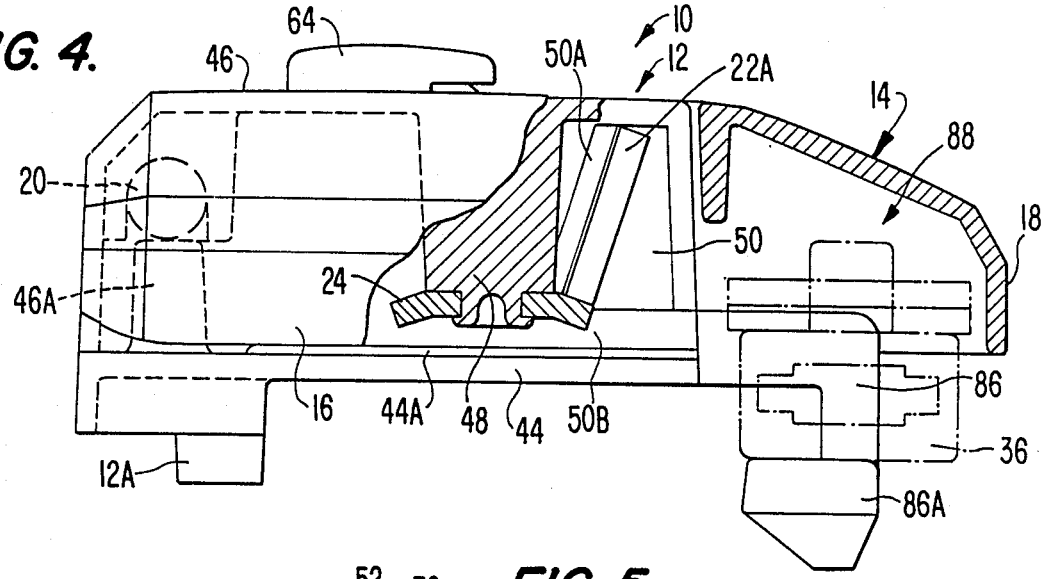
FIG. 4 is a partly sectional end elevation view of the apparatus seen from the right in FIG. 2.

In the preferred form of the apparatus, the loop 14 is a channel open toward the base 12 when the loop is in its closed position. The pivotal mounting of the loop on the base includes the pivot pins 20 integral with arms 16 and extending through corresponding openings in the end walls 38 of the housing. To permit insertion of the pivot pins, the openings may extend to the bottom of the end walls 38, and the frame may have integral abutments 46A which project from the frame to support the pivot pins 20 as shown in FIG. 4. The retainers 24 may be beveled plates mounted on integral post rivets 48 internally of the arms 16 as shown.

Figure 7:
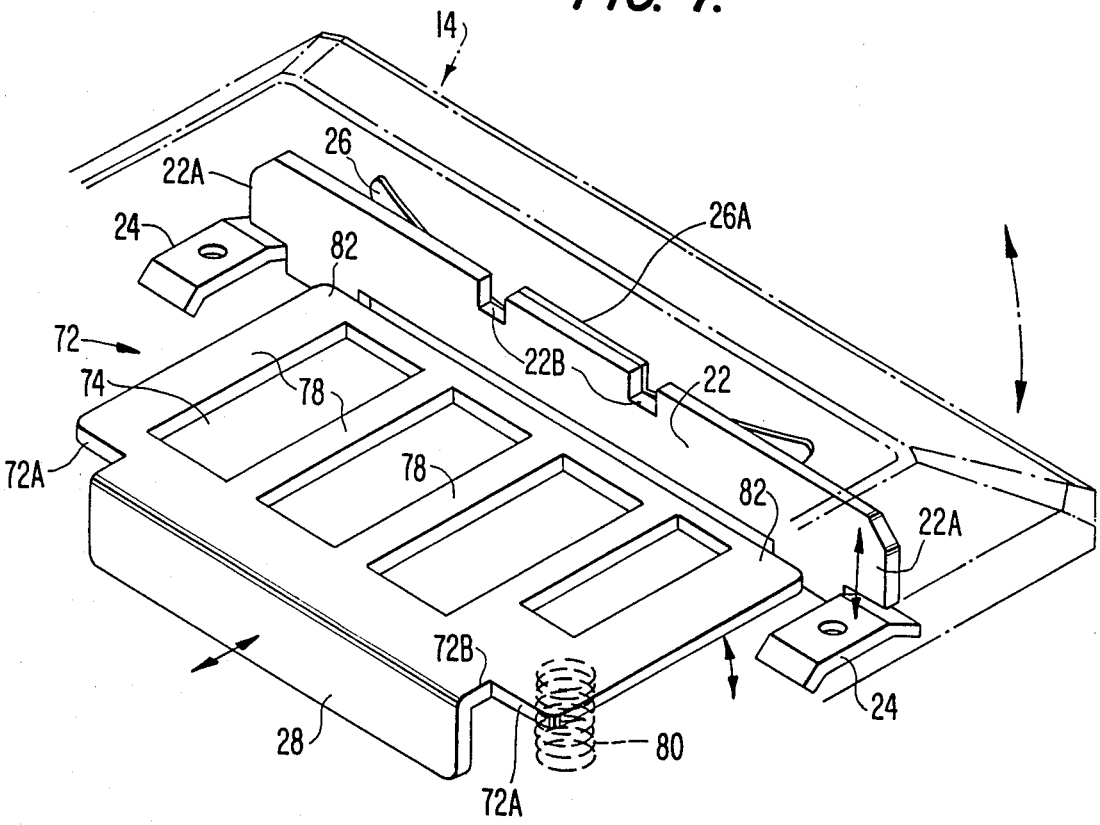
FIG. 7 is a perspective view illustrating certain components of the apparatus and their operation.

The latch member 22 has end portions 22A supported in trapezoidal slots 50 in the respective end walls 38 as shown in FIG. 4 and has notches 22B that receive positioning bosses 51 depending from the cover 46 of the housing. See FIGS. 2 and 7. One edge of each slot 50 may be extended outwardly as a lip 50A (FIG. 3) to form a stop for the pivotal movement of the latch member 22, and another edge of each slot may be extended outwardly as a lip 50B shaped to guide the arcuate movement of the corresponding end portion 22A of the latch member. Leaf spring 26 is bowed so that its central portion engages the latch member 22 as shown in FIGS. 3 and 7 and so that its ends engage the inner surface of side wall 42 as shown in FIG. 5. Spring 26 has a projecting edge portion 26A that fits between the bosses 51.

Latch member 22 is movable between a latching position shown in FIG. 4 and an unlatching position shown in FIG. 6. In the unlatching position, the latching member releases the retainers 24 to permit the loop to be lifted as indicated by phantom lines in FIG. 6. When the loop 14 is moved from the open position of FIG. 3 to the closed position of FIG. 1, the beveled retainers 24 engage the end portions 22A of latch member 22, moving the latch member to its unlatching position until the retainers 24 are beneath end portions 22A, whereupon the latch member returns to its latching position under the action of spring 26.

In the preferred form of the apparatus, the ability of the manual actuator 28 to release the latching mechanism is controlled by a combination lock 30. The combination lock includes a plurality of combination dials 52 mounted side-by-side for rotation on a shaft 54 (see FIG. 2). The dials protrude through slots in the cover 46 of the housing as shown in FIGS. 2, 5, and 6. Each dial has a corresponding sleeve 56 supporting the dial for rotation on the shaft 54 and normally rotatable as a unit with the dial. The sleeves are normally coupled to the dials by teeth (not shown) when the sleeves are in the position shown in FIG. 2, being held in engagement with the dials by the action of a coil spring 58 which surrounds the shaft at one end thereof and which urges the sleeves 56 into end-to-end abutment. The shaft is supported in the housing between lugs 60 on the cover 46 and lugs 62 on the frame 44.

As shown in FIG. 5, each sleeve 56 has a circular flange 56A with a flat portion 56B. When the dials are rotated to position the sleeves so that the flat portions 56B are all aligned as shown in FIG. 6, the lock is on-combination. When any dial is rotated away from the position of FIG. 6 (as shown in FIG. 5, for example), the lock is off-combination. The combination for opening the lock may be changed, after the lock has been set on-combination, by operating a combination changing member 64 mounted on the shaft 54 and movable transversely of the shaft (into the plane of FIG. 2 and along the plane of FIG. 3). Combination changing member 64 is slotted to permit such movement relative to the shaft and projects through a slot in the cover 46 as shown in FIG. 2. The combination changing member has a cam surface which engages a collar 66 integral with the shaft 54 for moving the shaft and the sleeves 56 to the left in FIG. 2, compressing the spring 58. Such movement of the sleeves along the axis of the shaft disengages the teeth of the sleeves from corresponding teeth of the dials and permits the dials to be rotated relative to the sleeves to select a new opening combination of the lock. When the combination changing member 64 is returned to its initial position, spring 58 couples the sleeves 56 to the dials 52 again, thereby establishing the new opening combination of the lock. The dials 52 are releasably held at successive rotational positions by the action of a dial spring 68 which cooperates with indexing notches 70 on the periphery of each dial.

Combination locks of the type just described are well known in the art and are described in greater detail in U.S. Pat. No. 4,389,863, for example.

The manual actuator 28 is preferably part of a bolt 72 (best seen in FIG. 7) of the combination lock. The bolt is a generally rectangular plate having a plurality of slots 74 through which the dials 52 and the combination changing member 64 protrude as shown in FIGS. 2, 5, and 6. In combination locks of the type described in U.S. Pat. No. 4,389,863, the bolt of the lock is supported for pivotal movement, but bolt 72 is supported in the housing 12 for both pivotal and translational movement. For this purpose (and others), the bolt extends through a slot 76 in the side wall 40 of the housing as shown in FIGS. 5 and 6. The upper edge of the slot has a rounded bolt-engaging surface 76A. The bolt has edges 72A (FIG. 7) that engage the inner surface of side wall 40 at opposite ends of slot 76 to limit movement of the bolt outwardly of the housing and has edges 72B that guide the translational movement of the bolt in the slot 76.

Bolt 72 has a series of bars 78 that are positioned to engage the flanges 56A and flat portions 56B of the sleeves 56, as is apparent in FIG. 2. The bolt is urged toward the sleeves 56 (and the shaft 54) by one or more springs, such as the coil spring 80 mounted in an integral sleeve 81 of the frame 44 and compressed between the bolt and the frame, as is apparent in FIGS. 2, 5, and 6. Bolt 72 has edge portions 82 at the side of the bolt opposite to the manual actuator 28, the edge portions being positioned to engage and move the latch member 22 when the combination lock is on-combination. At this time, it will be recalled, all of the flat portions 56B are aligned as shown in FIG. 6, permitting the spring 80 to pivot the bolt to the position shown in FIG. 6. When the combination lock is off-combination, the bolt is urged by one or more flanges 56A to the position shown in FIG. 5. In this position, edge portions 82 of the bolt engage abutments 84 formed integrally with the frame 44, thereby preventing translational movement of the bolt inwardly of the housing 12.

In FIG. 5, the latch member 22 is in its latching position, at which the latch member engages the retainers 24 as shown in FIG. 4, preventing lifting of the loop 14. In FIG. 6, the bolt 72 has been pivoted toward the shaft 54 by spring 80 and has been moved inwardly of the housing by pressure on the manual actuator portion 28, so as to move the latch member 22 to its unlatching position. When the bolt is in the position shown in FIG. 6, the combination dials 52 cannot be turned, because edge portions 82 of the bolt have been moved over the abutments 84, thereby preventing the pivotal movement of the bolt away from the shaft 54 that is required to allow the dials and sleeves to rotate. Spring 26, acting upon the latch member 22, acts upon the bolt 72 to move the bolt outwardly of the housing when the manual actuator 28 is not pressed inwardly of the housing 12. When the combination lock is then placed off-combination, the bolt 72 returns to the position of FIG. 5.

The apparatus described above is preferably employed as a double zipper lock. In conventional double zipper locks, an opening 36B in each of the zipper pull tabs is placed over a post attached to the base of the lock, and some means is provided to prevent the pull tabs from being removed from the post when the lock is closed. In accordance with the present invention, the apparatus is constructed so that the zipper sliders 36 (and in particular the slider bodies) are merely trapped without requiring engagement of the openings 36B with a post. This is accomplished by providing a chamber for each zipper slider in which the entire slider (including the body and the pull tab) is enclosed and trapped when the chamber is closed. In the apparatus that has been described herein, the chambers are provided by appropriate configuration of the loop 14 and the frame 44 (more particularly a base portion 86) and wings 86A which extend in opposite directions from base portion 86 as shown in FIGS. 2–6. One of the chambers, 88, is shown in FIGS. 4–6 defined by walls of the bight portion 18 and the wing 86A, the chamber being shown closed (but being shown open by the phantom lines in FIG. 6).

To lock the zipper, it is only necessary to pull the sliders 36 to positions adjacent to portion 86 of the base (by means of the pull tabs 36A) when the loop 14 is in the open position of FIG. 3, flip the pull tabs 36A back upon the slider (so that the pull tabs extend away from one another and are in a position for pulling the sliders to open the zipper again), place the loop 14 in the closed position of FIG. 1, and then turn the dials of the combination lock off-combination. The sliders will then be trapped in the chambers 88 between the wings 86A and the bight portion 18 of the loop until the apparatus is operated in the manner previously described to permit lifting of the loop and release of the sliders. The wings 86A, which are preferably tapered as shown, support the sliders 36 and prevent depression of the fabric of the soft-sided luggage case which might allow the sliders to escape from under the loop. To permit the sliders 36 to be drawn over the wings 86A, the wings are suspended cantilever-fashion from the base portion 86, as is apparent in the drawings This permits the wings 86A to be inserted under the zipper so that the sliders 36 may be drawn over the wings for support, as indicated in phantom lines in FIGS. 3, 4, and 6.

As shown in FIGS. 2 and 3, portions of the frame 44 which extend beyond end walls 38 have integral pads 44A which fit under the arms 16 of the loop to prevent the insertion of a thin tool that might be used to engage the latch member 22 and release the loop without use of the combination lock. The sliders 36 under the bight portion 18 of the loop will normally prevent a tool from being inserted past side wall 42 to engage the end portions 22A of the latch member, but the channel configuration of the bight portion of the loop (particularly the wall of the channel closest to side wall 42) may be extended, or walls may be added to the base, so as to block any access to the end portions 22A of the latch member.

The apparatus described has a feature that is particularly desirable when a combination lock is used to control the ability of the manual actuator 28 to release the latch mechanism. This feature permits the loop 14 to be returned to its closed position even when the lock is off-combination, so that after the lock is set on-combination and the loop is lifted, the lock may be immediately set off-combination to prevent observation of the opening combination of the lock. When the lock is off-combination, as shown in FIG. 5, the manual actuator 28 cannot move the latch member 22. However, the latch member 22 is free to move to its unlatching position independently of the manual actuator. This permits the loop 14 to be moved to its closed position, as described earlier, regardless of the setting of the combination lock.

Although, as described earlier, the apparatus is constructed so that it may be operated by one hand, the fact that the manual actuator 28 must be pressed to permit lifting of the loop 14 prevents inadvertent release of the zipper sliders which might occur if movement of the loop 14 away from its closed position depended solely on the setting of the combination lock on-combination.

From the foregoing description, it is apparent that the invention provides a double zipper lock that is simple to use. While a preferred embodiment of the invention has been shown and described, it will be apparent to those skilled in the art that changes can be made in this embodiment without departing from the principles and spirit of the invention, the scope of which is defined in the appended claims.

The invention claimed is:

1. In combination with a zipper device on a luggage case, said zipper device having a pair of zipper sliders that are at predetermined locations adjacent to one another when the zipper device is closed, each zipper slider including a body that operates zipper teeth and a pull tab connected to the body, zipper locking apparatus comprising a base with means for attaching the base to the luggage case adjacent to said predetermined locations and having means for defining a pair of chambers for enclosing said zipper sliders at said predetermined locations substantially entirely with the pull tabs of the sliders extending away from one another and for trapping said zipper sliders merely by said enclosing, said chambers being defined in part by a member supported on said base for pivotal movement about an axis substantially parallel to said zipper device at one side thereof, said pivotal movement being between a first position in which the chambers are open and a second position in which the chambers are closed, and means for releasably latching said member in said position.

2. A combination in accordance with claim 1, wherein said latching means has locking means associated therewith which must be unlocked to permit said member to move from said second position to said first position.

3. A combination in accordance with claim 2, wherein said locking means comprises a combination lock.

4. In combination with a zipper device on a luggage case, said zipper device having a pair of zipper sliders that are at predetermined locations adjacent to one another when the zipper device is closed, zipper locking apparatus comprising a base having a pair of oppositely extending cantilevered portions configured to extend under a zipper device and to support respective zipper sliders thereon, means for attaching the base to the luggage case adjacent to said predetermined locations, and means for defining a pair of chambers for enclosing and trapping said zipper sliders at said predetermined locations, said chambers being defined in part by a member supported on said base for pivotal movement about an axis substantially parallel to said zipper device at one side thereof, said pivotal movement being between a first position in which the chambers are open and a second position in which the chambers are closed, each of the chambers being configured to receive a zipper slider therein, and means for releasably latching said member in said second position.

5. A combination in accordance with claim 4, wherein each zipper slider includes a body that operates zipper teeth and a pull tab connected to the body, and wherein the chambers are configured to enclosed respective zipper sliders substantially entirely, with the pull tabs of the sliders extending away from one another.

6. A combination in accordance with claim 4, wherein said latching means has locking means associated therewith which must be unlocked to permit said member to move from said second position to said first position.

7. A combination in accordance with claim 6, wherein said locking means comprises a combination lock.

* * * * *